United States Patent [19]

Degenhart

[11] Patent Number: 4,724,410

[45] Date of Patent: Feb. 9, 1988

[54] ELECTRICAL CONTACTOR

[75] Inventor: Thomas W. Degenhart, Bloomington, Ill.

[73] Assignee: Furnas Electric Company, Batavia, Ill.

[21] Appl. No.: 911,447

[22] Filed: Sep. 25, 1986

[51] Int. Cl.[4] ..... H01H 67/02

[52] U.S. Cl. ..... 335/132; 335/131; 335/202

[58] Field of Search ..... 335/132, 202, 131, 133, 335/198

[56] References Cited

U.S. PATENT DOCUMENTS 3,469,215 9/1969 Brovedan ..... 335/132

4,506,243 3/1985 Okado et al. ..... 335/132

*Primary Examiner*—E. A. Goldberg

*Assistant Examiner*—Lincoln Donovan

*Attorney, Agent, or Firm*—Wood, Dalton, Phillips, Mason & Rowe

[57] ABSTRACT

An electrical contactor including a generally U-shaped base 12 having a bight 44 and parallel upstanding legs 22 terminating in mounting flanges 50, a contactor assembly 10 including an insulator 28 abutting the flanges 50 and having a movably mounted electrical contact 22, and a plastic shell 14 disposed between the legs 42 and sandwiched between the bight 44 and the insulator 28. A magnetic core 16, an electrical coil 48 and an armature 20 are included in the assembly.

13 Claims, 7 Drawing Figures

FIG. 1
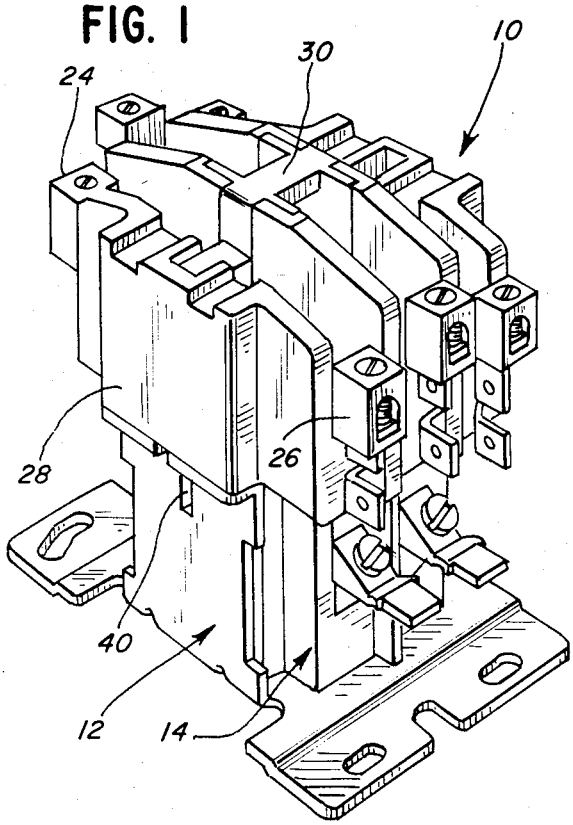
FIG. 2
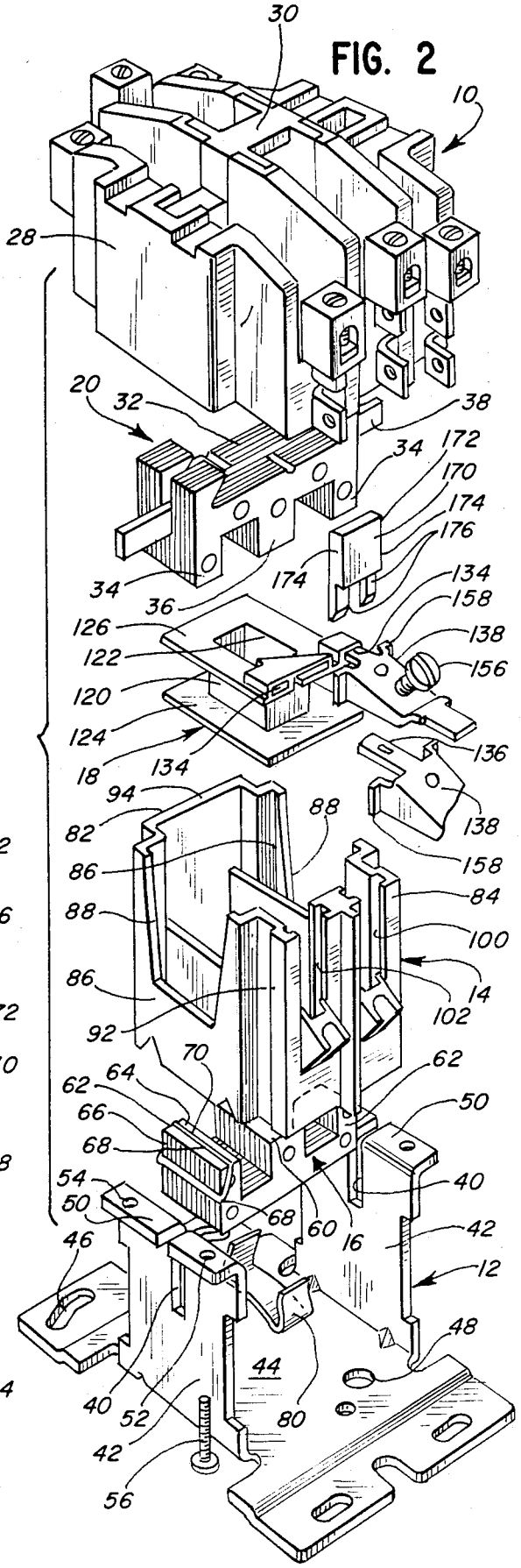
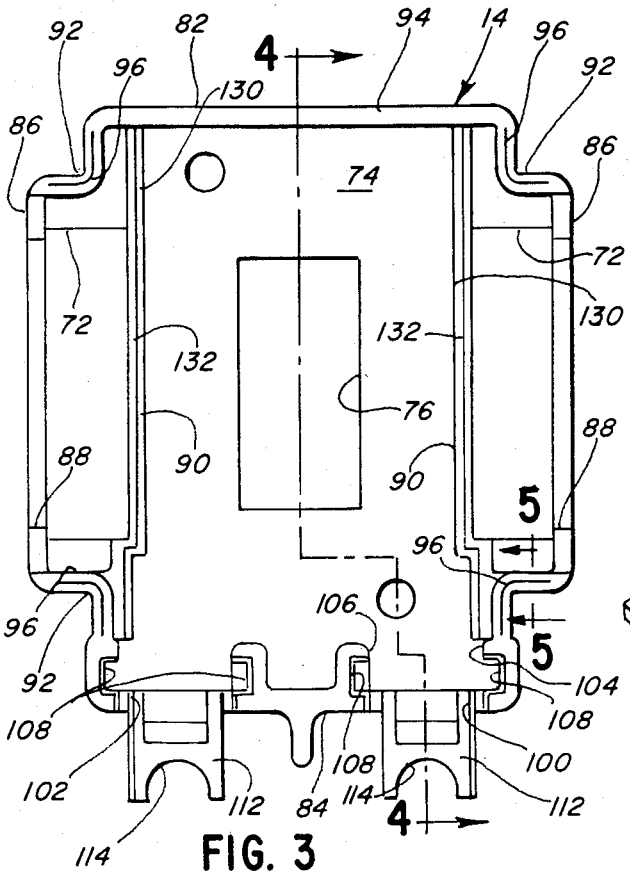
FIG. 3

ELECTRICAL CONTACTOR

FIELD OF THE INVENTION

This invention relates to an electrical contactor, and more particularly, to a relay type contactor.

BACKGROUND OF THE INVENTION

Electrical contactors of various sorts have been utilized in a large variety of applications for many years. As a consequence, the art is quite well developed and competitive offerings are comparable in terms of reliability and long life.

Consequently, much of the competition between manufacturers revolves principally about price. It is, therefore, highly desirable to provide a contactor assembly that can be manufactured most economically and yet retain or improve upon the reliability of prior art constructions.

The present invention is directed to accomplishing that result.

SUMMARY OF THE INVENTION

It is the principal object of the invention to provide a new and improved electrical contactor. More specifically, it is an object of the invention to provide a contactor construction that can be economically fabricated to provide an extremely reliable and long-lived contactor.

According to one facet of the invention, this object is achieved in a contactor including a generally U-shaped base having a bight and parallel upstanding legs. The legs terminate in mounting flanges and a contactor assembly including an insulator abuts the flanges. The contactor assembly includes at least one movably mounted electrical contact. Means extend between the flanges and the insulator to secure the insulator to the base.

A plastic shell having a height on the order of the length of the legs is located between the legs and is sandwiched between the bight and the insulator. The shell has an upper edge abutting the insulator and defines an interior coil chamber. Means including a coil are disposed within the chamber for operating the contact. Terminal slots are located in the shell and terminals extend from the coil exteriorly of the shell through the slots. Slot closures are provided for accomplishing the dual function of closing the slots to isolate the coil and firmly clamp the terminals against the shell for mounting purposes.

In a highly preferred embodiment, the closures slide into the slots and the construction further includes complementary wedging surfaces on the closures and the terminals to wedge the terminals in place.

The invention further includes the use of complementary locating formations on the shell and the base for orienting the shell on the base. In this embodiment of the invention, the securing means comprise the sole means holding the base, the shell and the contactor assembly in assembled relation.

According to another facet of the invention, there is provided a contactor including a generally U-shaped base have a bight and parallel upstanding legs. A contactor assembly is provided as before along with securing means. An armature is connected to the movably mounted contact and has at least one pole directed toward the base. Guide means interconnect the base and the armature for guiding the armature in a predetermined path of movement relative to the base and a magnetic core having at least one pole aligned with and facing the armature pole is disposed between the legs of the base. A shell having a height on the order of the length of the legs is disposed between the legs as before and is sandwiched between the bight and the insulator. The shell has a raised bottom with an opening for each pole of the core. The shell further has side walls which, together with the bottom, define a coil chamber of predetermined size about the pole hole and the pole received therein. A plastic bobbin is located about the pole and has a first side edge nestingly received in the coil chamber adjacent the bottom and in contact with the sides thereof along with the second side edge abutting the sides so as to close the coil chamber. Electrical isolation means extend between the wall sides and the second side edge of the bobbin.

The interface of the bobbin second side and the shell side walls is provided with an ultrasonic weld bead according to the preferred embodiment of the invention.

According to still a further facet of the invention, there is provided a base, a contactor assembly, an armature, guide means, a magnetic core, a shell and a bobbin as before. The bobbin is provided with a winding which extends to two spaced recesses at one edge of the bobbin. Electrical winding terminals are located in those recesses and extend away from the edge of the bobbin through slots as mentioned previously.

In a highly preferred embodiment, the terminals have tabs which are oppositely directed and which are received in grooves formed in the sides of the slots within the shell. In a highly preferred embodiment, such tabs have a thickness less than the width of the grooves to facilitate their receipt therein and wedge means as mentioned before are provided. In a highly preferred embodiment, the slot closures, at their interface with the respective slots, include frictional wedging ridges.

In a preferred embodiment of the invention, the armature has three, in-line spaced poles and the bottom has three in-line holes. The central one of the holes opens to the coil chamber and the remainder of the holes are located exteriorly of the coil chamber. Some of the poles on the magnet include slots and pole shading rings are disposed in such slots. The shell further includes surfaces adjacent the holes which extend in close adjacency to the slots in the poles to engage and hold the pole shading rings therein.

A preferred embodiment also contemplates that the core be sandwiched between the raised bottom of the shell and the bight of the base.

Other objects and advantages will become apparent from the following specification taken in connection with the accompanying drawings.

DESCRIPTION OF THE DRAWINGS

FIG. 1 is a perspective view of a contactor made according to the invention;

FIG. 2 is an exploded view of the contactor;

FIG. 3 is a plan view of a shell utilized in the contactor;

DESCRIPTION OF THE PREFERRED EMBODIMENT

Figure 4:
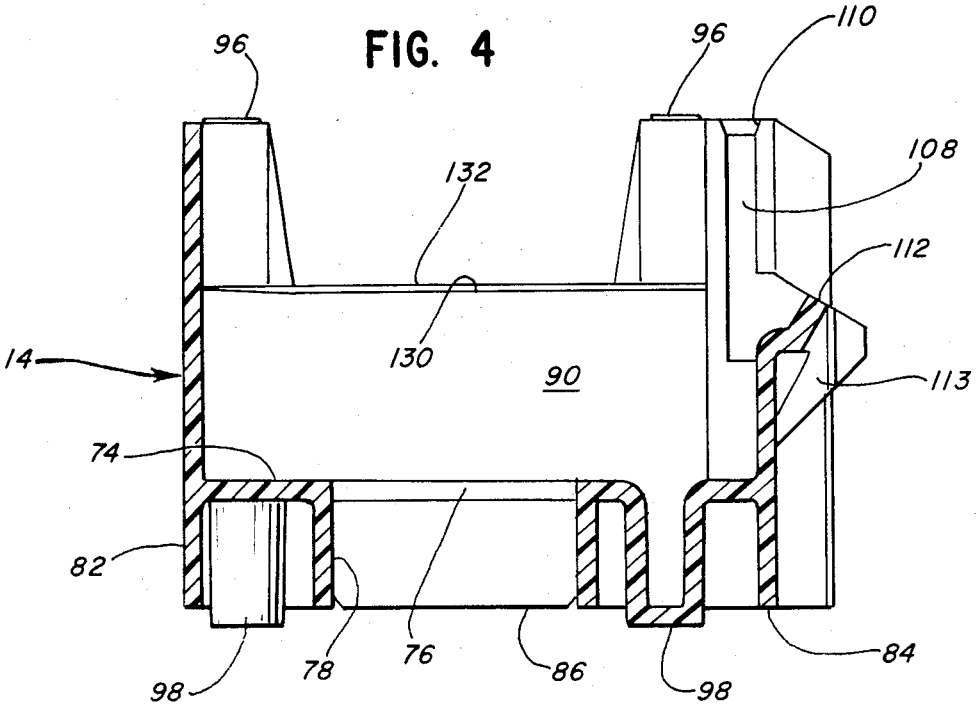
FIG. 4 is a sectional view of the shell taken approximately along the line 4—4 in FIG. 3.

An exemplary embodiment of an electrical contactor made according to the invention is illustrated in the drawings and with reference to FIGS. 1 and 2, is seen to be composed of six principal components. A first is an upper contactor assembly, generally designated 10 and a second is a generally U-shaped base, generally designated 12. A shell, generally designated 14, is located between the base 12 and the contactor assembly 10 and with the former serves to locate a magnetic core, generally designated 16, within the assembly. The core 16 is made of laminated magnetic steel.

A bobbin, coil and terminal assembly, generally designated 18, is housed within the shell 14 as will be described hereinafter and the overall construction is completed by a laminated magnetic steel armature, generally designated 20, which is conventionally associated with movable contacts such as shown fragmatically at 22 in the contactor assembly 10.

Considering the contactor assembly 10 specifically, the same is of known type and, as mentioned previously, includes a plurality of isolated, movable contacts such as the contact 22 which is operable, upon movement of the armature 22 toward the base 12, to establish electrical circuit between opposed terminals 24 and 26 respectively. As illustrated in FIG. 1, the contactor is a three-pole contactor electrically speaking. If desired, the same could be made in the configuration illustrated in commonly assigned U.S. Pat. No. 3,824,509 issued July 16, 1974, to McGary, the details of which are herein incorporated by reference.

The main part of the contactor is a housing 28 of an insulating plastic. Slidable within the insulator housing 28 is a insulating plastic bar 30 which is operable to move the contacts 22 as mentioned previously. The bar 30 is connected by any suitable means to a dovetail slot 32 in the upper surface of the armature 20. In this way, movement of the armature 20 effects closure of the contacts 22. A biasing spring (not shown) is employed to bias the contacts 22 to an open position.

Turning now to the armature 20, in addition to the dovetail slot 32, oppositely thereof the same has three magnetic poles including side poles 34 and a central pole 36 which face the base 12. Extending from the sides of the armature 20 is a guide bar 38. Opposite ends of the guide bar 38 are received in vertical slots 40 at the upper ends of parallel legs 42 of the U-shaped base 12. Thus, the armature 20 is guided for movement toward and away from the bight 44 of the U-shaped base 12.

As illustrated, the bight 44 includes fastener receiving openings such as illustrated at 46 whereby the contactor may be secured in a desired location through the use of a threaded fastener or the like. The bight 44 may also include locating holes 48 for purposes to be seen.

The legs 42 terminate in outwardly directed flanges 50. The flanges 50 are generally parallel to the bight 44 and each includes a fastener receiving aperture 52 and a locating hole 54. A threaded fastener 56 is passed upwardly through each aperture 52 to be threaded into an aligned bore (not shown) in the underside of the insulator housing 28 of the contactor assembly 10. That same underside may have a small, downwardly projecting post (also not shown) receivable in a corresponding one of the locating holes 54 so as to assure proper orientation of the insulator housing is and thus the contactor assembly 10, on the base 12.

The magnetic core 16 is generally E-shaped as illustrated in FIG. 2 and includes a central pole 60 aligned hole and facing the pole 36 on the armature 20. The central pole 60 is flanked by side poles 62 facing and aligned with the poles 34. Each of the side poles 62 has an upper surface 64 and a side surface 66. Furthermore, each of the surfaces 64 and 66 includes a slot 68 and an O-shaped pole shading ring 70 has its long sides disposed in the slots 68 in the surfaces 64 and 66 for conventional purposes.

The side poles 62 are respectively received in openings 72 in a raised bottom 74 of the shell 14. The holes 72 are best seen in FIG. 3. The bottom 74 also includes a central hole 76 in which the central pole 60 of the core 16 is received. As seen in FIG. 4, the hole 76 is surrounded by a downwardly directed wall 78.

A U-shaped spring 80 (FIG. 2) may be placed on the core 16 from the underside thereof in alignment with the central pole 60. The spring 80 is used to control the so-called "bounce" of the contacts 22 and function by dissipating through friction, kinetic energy in the core and armature system.

The shell 14 made of an insulating plastic includes an upstanding rear wall 82, a forward wall 84, and opposed side walls 86, the latter having slots 88 which serve to accommodate movement of the bar 38 within the slots 40 in the base 12. The shell 14 also includes internal side walls 90 which are spaced from the side walls 86 a distance equal to the width of the holes 72. The walls 90, together with the rear wall 82, bottom 74 and forward wall 84 define a coil chamber around the central hole 76 above the bottom 74 and a core chamber for the core 16 below the bottom 74.

One feature of the invention is the proximity of the walls 86 and 90 to each other in relation to the holes 72. In particular, the arrangement is such that the inner surface of the side walls 86 form a slight interference fit with the associated pole shading ring 70 on the adjacent side pole 64, and in particular, that portion of the pole shading ring 70 in the groove 68 on the side face 66. Thus, the pole shading ring 70 may be assembled to the associated poles and then the core 16 inserted into the shell 14. When fully inserted, the interiors of the side walls 86 will permanently hold the pole shading rings 70 assembled to the respective poles 62.

Figure 5:
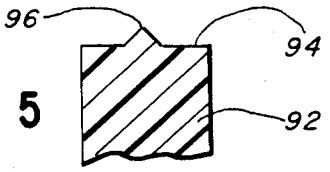
FIG. 5 is an enlarged, fragmentary view taken approximately along the line 5—5 in FIG. 3.

As best seen in FIGS. 2 and 3, the shell 14 is provided with inverted corners 92 where the walls 82, 84 and 86 join. At the upper surface 94 of those walls, and more particularly, at the upper surface of the inverted corners, as seen in FIGS. 3–5 inclusive, a small upstanding crush ridge 96 is provided. Preferably, the height of the walls 82, 84 and 86 is equal to the length of the legs 42 and the ridges 96 extend slightly thereabove so as to be engageable with the underside of the insulating housing 28 while the latter is slightly spaced from the flanges 50. Because both the insulating housing 28 and the shell 14 are made of plastic, tightening of the fastener 56 will cause the insulation housing 28 to crush the ridges 96. This will result in a tight assembly of the various components.

As seen in FIG. 4, the underside of the shell 14 may be provided with downwardly extending posts 98 which extend just slightly below the lower extremities of the walls 82, 84 and 86. The posts 98 serve as locating posts and are adapted to be received in the locating holes 48 in the bight 44 of the base 12 to assure proper location of the shell 14 with respect thereto.

As seen in FIGS. 2, 3 and 4, the front wall 84 of the shell 14 includes two spaced terminal receiving slots 100 and 102. Since the slots 100 and 102 are by and large identical, only the slot 100 will be described. The same has vertically extending sides 104 and 106 facing each other and each of the sides 104 and 106 is provided with a groove 108 which opens towards the opposite side and the groove 108 therein. As seen in FIG. 4, the upper end of each of the grooves may be somewhat flared as shown at 110 for purposes to be seen.

At the bottom of each of the slots 100 and 102 there is a terminal support surface 112 in the form of an ear 113 extending from the front wall 84. The surface 112 is angled at approximately the angle shown in FIG. 4 and terminates in an arcuate fastener receiving recess 114 (FIG. 3). The purpose of this construction will be described in greater detail hereinafter.

Turning now to the bobbin, coil and terminal assembly 18, the same is seen to include a rectangular, plastic bobbin 120 having a central opening 122 which aligns with the hole 76 in the shell 14 and thus allows the bobbin 120 to be disposed about the central pole 60 of the core 16.

The bobbin 20 has a lower flange 124 which is adapted to be snugly received within the coil chamber defined by the interior of the walls 82, 84 and 90 in substantial abutment therewith. The bobbin 20 also includes a somewhat larger rectangular upper flange 126 which is dimensioned in the same fashion as the lower flange 124 save for the fact that it is adapted to abut and overlie the upper surfaces 130 of the side walls 90. And as seen in FIGS. 3 and 4, the upper surfaces 130 of the walls 90 are provided with an upwardly extending projections 132 which are similar to the ridges 96 and which may serve as an ultrasonic weld bead. Thus, once the bobbin 120 is disposed within the coil chamber, the same may be fused in place by ultrasonic welding to the upper surfaces 130 of the side walls 90.

Figure 6:
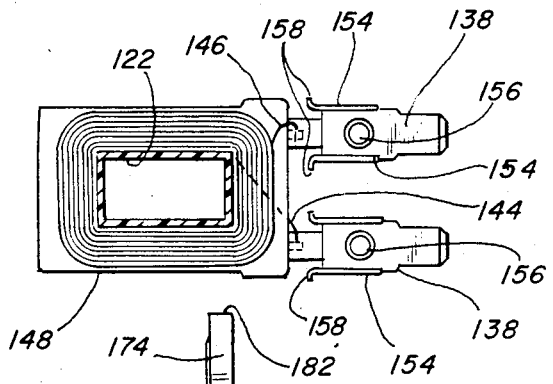
FIG. 6 illustrates a bobbin, coil and terminal assembly utilized in the contactor with one bobbin flange removed for clarity.
Figure 7:
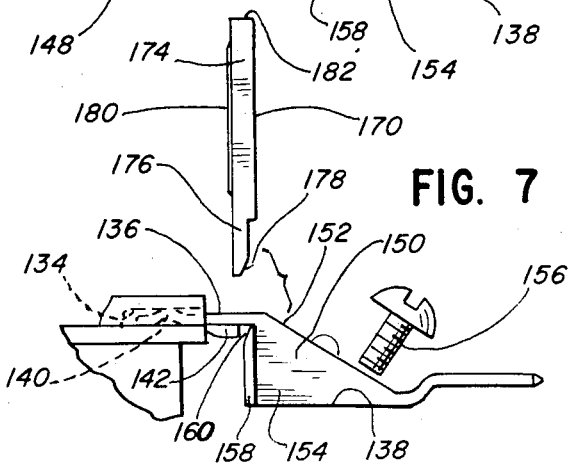
FIG. 7 is an enlarged, fragmentary view of a terminal assembly and a closure for terminal receiving slots in the shell.

The upper flange 126 is provided with spaced recesses 134 which are aligned with the slots 100 and 102 in the shell 14. As seen in FIGS. 2, 6 and 7, the recesses 134 are adapted to respectively receive a tongue 136 on an associated terminal 138. The terminals 138 are, of course, formed of a suitable conductor. As seen in FIG. 7, each of the tongues 136 is provided with a dimple 140 for wedging within the associated recess 134 as well as a reversely bent tab 142 which serves two purposes. A first is to limit the degree of insertion of the terminal 138 into the recess 134. A second is to be crimped upon an electrical conductor, the ends 144 and 146 of which are illustrated in FIG. 6. The ends 144 and 146 are, of course, the ends of a coil 148 wound about the bobbin 120 which will therefore be disposed about the central pole 60 of the magnetic core 16.

The bobbin flanges 124 and 126 provide electrical isolation of the coil 148 from the central pole 60 of the core 16 as is well known. The interior side walls 90 extend downwardly to the raised bottom 74, which, together with the side walls 90 provides electrical isolation of the lower and intermediate portions of the coil 148 from the side poles 62. Advantageously, the ultrasonic weld bead provided through the use of the projections 132 blocks any air gap extending between the upper ends of the side poles 62 and the upper portions of the coil 148 to provide effective electrical isolation at this location as well. Of course, other means of eliminating any othe rair gaps in this location may be employed as desired. For example, in some instances it might be desirable to replace the ultrasonic weld with a solvent weld. Alternatively, in certain cases, a snap fit connection between the upper surfaces 130 of the side walls 90 and the upper bobbin flange 126 will provide suitable electrical isolation.

Intermediate its ends, each of the terminals 138 includes a threaded fastener receiving section 150. The section 150 includes a first surface 152 which is angled to abut the surface 112 on the associated ear 113. For strengthening purposes, triangular side surfaces 154 depend from each side of the surface 152. The latter is provided with an aperture for receipt of a terminal screw 156 or the like which may extend freely into the corresponding recess 114.

As perhaps best seen in FIG. 6, each of the side surfaces 154 of each terminal 38 is provided with an outwardly directed wing 158. The two wings 158 on each terminal 138 are adapted to be received in the grooves 108 in each of the slots 100 and 102 for locating purposes. As can be appreciated from a comparison of FIGS. 4 and 7, which are generally on the same scale, the wings 158 are narrower than the grooves 108 to facilitate easy entry of the same into the grooves. In addition, as seen in FIG. 7, the upper edge of each wing 158 is slightly beveled as at 160.

The contactor assembly is also provided with slot closures 170 (FIGS. 2 and 7) for each of the slots 100 and 102. As perhaps best seen in FIG. 2, each slot closure 170 is basically a rectangular panel 172 having side edges 174 that are relatively snugly receivable within the grooves 108 in each of the slots 100 and 102. From the bottom of the panel 172, a pair of spaced legs 176 depend. The spacing between the legs 176 is such as to just accommodate the width of the tongues 136 on the terminals 138.

In addition, at the ends of the legs 176, there is provided a beveled surface 178 which faces the beveled surface 160 on each of the wings 158. Immediately adjacent each side edge, a projection 180 identical to the projection 96 is provided.

When the bobbin 120 is assembled to the shell 14 with the terminals 138 in place and extending through the slots 100 and 102 with the wings 158 disposed in the grooves 108, the slots 100 and 102 may then be closed by respective slot closures 170 which are readily started in the grooves 108 because of the presence of the taper or flare 110. The closures 170 are forced downwardly within the associated slots sufficiently to bring the surface 178 into contact with the surface 160. Further downward movement until the upper end 182 of the associated closure 170 is in the plane of the upper surface 94 of the shell 14 will result in a wedging action taking place wherein the wings 158 will be tightly urged against the forward edge of the associated groove 108 by the legs 176. As a consequence, the terminals 138 are tightly frictionally held in place without the use of fasteners of any sort. Frictional retention may be enhanced by the provision of a projection 180 similar to the crush ridge 96 which wedges against the sides of the grooves 108 whereby the closures 170 are firmly held in place.

From the foregoing, it will be appreciated that the contactor made according to the invention provides for ease of manufacture and thus may be more economically made, and competitively sold. Furthermore, reliability is maintained or improved over prior art constructions.

I claim:

1. A contactor comprising:

a generally U-shaped base having a bight and parallel upstanding legs, said legs terminating in mounting flanges;

a contactor assembly including an insulator abutting said flanges and a movably mounted electrical contact;

means extending between said flanges and said insulator for securing said insulator to said base;

an armature connected to said movably mounted contact and having at least one pole directed toward said base;

guide means interconnecting said base and said armature for guiding said armature in a predetermined path of movement relative to said base;

a magnetic core having at least one pole aligned with and facing said armature pole, said core being disposed between said legs;

a shell having a height on the order of the length of said legs located between said legs and sandwiched between said bight and said insulator, said shell having a raised bottom with a hole for each pole of the core, with the pole(s) of said core extending through said hole(s) said shell further having side walls which, with said bottom define a coil chamber about said hole;

a bobbin within said coil chamber and having a flange abutting said side walls to close said coil chamber, said bobbin being disposed on the core pole extending through said hole and having two spaced recesses at one edge of said side;

a winding on said bobbin and extending to said recesses;

electrical winding terminals in said recesses and extending away from said edge, said terminals having oppositely directed wings intermediate their ends;

a pair of slots in a side wall of said shell and aligned with said terminals, such that said terminals extend through said slots to the exterior of said shell the sides of said slots having grooves receiving respective ones of said wings; and slot closures, one for each of said slots and formed of insulating material, said slot closures having side edges received in said grooves in overlying relation to said tabs.

2. The contactor of claim 1 wherein the interface of said bobbin flange and said shell side walls is provided with a weld.

3. The contactor of claim 2 wherein said weld is an ultrasonic weld bead.

4. The contactor of claim 1 whrein said tabs have a thickness less than the width of said grooves to facilitate their receipt therein, and said closures include a wedge formation engageable with the associated tabs to firmly wedge the tabs in the associated grooves so as to firmly affix said winding terminals to said shell.

5. The contactor of claim 4 wherein the interface of said closures and said slots include ridges for functionally holding said closures in said slots..

6. The contactor of claim 1 wherein each of said core and said armature has three, in-line spaced poles and said bottom has three in-line said holes, the central one of said holes opening to said coil chamber and the remainder of said holes being located exteriorly of said coil chamber.

7. The contactor of claim 6 wherein said core is sandwiched between said raised bottom and said bight.

8. The contactor of claim 6 wherein at least some of said poles on said core have slots, and further including pole shading rings in said pole slots, said shell including surfaces adjacent the holes and extending in close adjacency to said pole slots to engage and hole said pole shading rings therein.

9. A contactor comprising:

a generally U-shaped based having a bight and parallel upstanding legs, said legs terminating in mounting flanges;

a contactor assembly including a plastic insulator abutting said flanges and a movably mounted electrical contact;

means extending between said flanges and said insulator securing said insulator to said base;

a plastic shell having a height on the order of the length of said legs located between said legs and sandwiched between said bight and said insulator, said shell having an upper edge abutted to said insulator and defining an interior coil chamber;

means including a coil within said chamber for operating said contacts;

terminal slots in said shell;

terminals extending from said coil exteriorly of said shell through said slots; and slot closures for (a) closing said slots to isolate said coil, and (b) firmly clamping said terminals against said shell.

10. The contactor of claim 9 wherein said closures slide into said slots and further including complementary wedging surfaces on said closures and said terminals.

11. The contactor of claim 9 further including complementary locating formations on said shell and said base for orienting said shell of said base, said securing means comprising the sole means holding said base, said shell and said contactor assembly in assembled relation.

12. A contactor comprising:

a generally U-shaped base having a bight and parallel upstanding legs, a contactor assembly including an insulator abutting said base and a movably mounted electrical contact;

means extending between said base and said insulator and securing said insulator to said base;

an armature connected to said movably mounted contact and having at least one pole directed toward said base;

guide means interconnecting said base and said armature for guiding said armature in a predetermined path of movement relative to said base;

a magnetic core having a central pole aligned with and facing said armature pole and flanking side poles, said core being disposed between said legs;

a shell of insulating material having a height on the order of the length of said legs located between said legs and sandwiched between said bight and said insulator, said shell having a raised bottom with a hole for each pole of the core with the poles of the core extending through said holes, a coil chamber of predetermined size about the hole associated with said central pole, and between the holes associated with said side poles;

a plastic bobbin and associated winding about said central pole and having a first flange nestingly received in said coil chamber adjacent said bottom and in contact with the sides thereof; and a second flange abutting said sides so as to close said coil chamber; and electrical isolating means between said sides and said second side flange to thereby isolate said winding from said side poles.

13. The contactor of claim 12 where said isolating means comprise a weld.

* * * * *